US006227139B1

(12) United States Patent
Nguyen et al.

(10) Patent No.: US 6,227,139 B1
(45) Date of Patent: May 8, 2001

(54) CONTROL TAB ASSISTED LIFT REDUCING SYSTEM FOR UNDERWATER HYDROFOIL SURFACE

(75) Inventors: Thang D. Nguyen, Vienna, VA (US); Scott Gowing, Gaithersburg, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/526,451

(22) Filed: Mar. 16, 2000

(51) Int. Cl.[7] ..... B63G 8/18; B63B 1/28
(52) U.S. Cl. ..... 114/332; 114/280; 114/285
(58) Field of Search ..... 114/274, 280, 114/275, 284, 285, 167, 330, 331, 332, 126; 244/215–217

(56) References Cited

U.S. PATENT DOCUMENTS

| | | | | |
|---|---|---|---|---|
| 1,661,114 | * | 2/1928 | Flettner | 114/163 |
| 2,562,227 | | 7/1951 | Zobel . | |
| 2,658,701 | * | 11/1953 | Robertson . | |
| 2,804,038 | * | 8/1957 | Barkla | 114/280 |
| 3,520,264 | * | 7/1970 | Scherer | 114/280 |
| 3,977,348 | * | 8/1976 | Bordat et al. | 114/280 |
| 4,100,876 | | 7/1978 | Feleus . | |
| 4,213,587 | | 7/1980 | Roeseler et al. . | |
| 4,345,538 | | 8/1982 | Warner et al. . | |
| 5,237,947 | | 8/1993 | Manning . | |
| 5,366,176 | * | 11/1994 | Loewy et al. | 244/75 R |
| 5,520,137 | | 5/1996 | Arii et al. . | |

* cited by examiner

*Primary Examiner*—Sherman Basinger
(74) *Attorney, Agent, or Firm*—John Forrest; Jacob Shuster

(57) ABSTRACT

A hydrofoil stabilizer fixed to an underwater hull and provided with a pair of pivotally deflectable control flaps through which surface lift on the stabilizer is controlled, is provided with trailing edge tabs on both of the flaps that are pivotally deflected in the same direction to further offset and thereby improve recovery from surface jam inducing lift force on the stabilizer which adversely affects maneuvering control.

5 Claims, 1 Drawing Sheet

FIG. 1
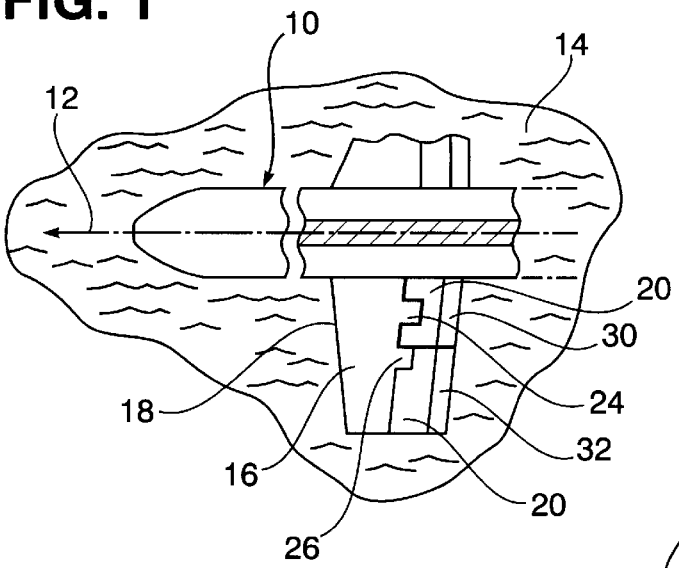
FIG. 2
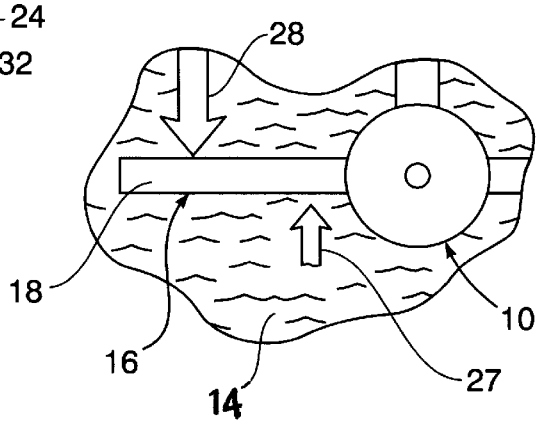
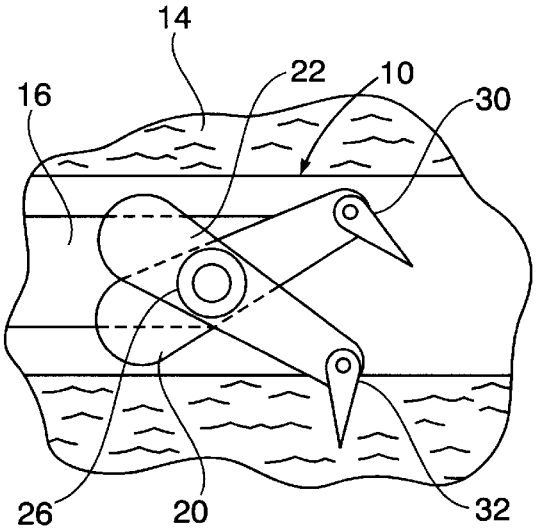
FIG. 3
FIG. 4
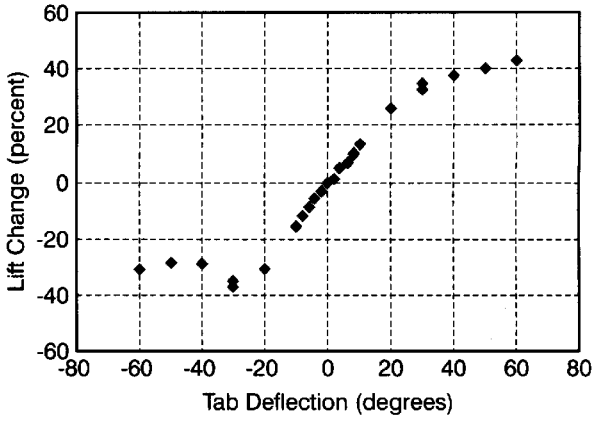

CONTROL TAB ASSISTED LIFT REDUCING SYSTEM FOR UNDERWATER HYDROFOIL SURFACE

The present invention relates to maneuvering control over marine vessels, adversely affected by control surface.

BACKGROUND OF THE INVENTION

Certain types of marine vessels such as submarines and hybrid hydrofoil vehicles are provided with underwater hydrofoil stabilizers having trailing edge control flaps subject to undesirable pivotal deflection by control surface jamming to adversely effect vessel maneuvering control. Control tabs have been utilized on airfoil flaps associated with aircraft and on hydrofoil flaps associated with surface ships and submersible seawater vessels to modify control of surface lift forces by deflection of the flaps. Such prior art use of control surface tabs has not however been applied to underwater marine vessel hull installations to address control surface jam problems.

SUMMARY OF THE INVENTION

In accordance with the present invention, trailing-edge control tabs are mounted on movable flaps of certain underwater vessel installations to assist in vessel maneuvering control by reducing undesirable lift produced as a result of jamming of a flap pivotally mounted on a stabilizer fixed to the underwater hull of the vessel. The invention applies to partial span flap configurations respectively formed by pairs of movable flaps mounted on fixed stabilizers. A trailing-edge control tab is pivotally mounted on each of the movable flaps for deflection independently of the other control tab. Thus, when one of two control flaps gets jammed with resulting undesirable lift force exerted on it in one direction, both of the trailing-edge control tabs are deflected in opposite directions to substantially add to the counter-effect of the other control flap associated with the unaffected surface span, by virtue of its deflection in said direction opposite to the deflection direction of the flap on the jammed surface span.

BRIEF DESCRIPTION OF DRAWING

A more complete appreciation of the invention and many of its attendant advantages will be readily appreciated as the same becomes better understood by reference to the following detailed description when considered in connection with the accompanying drawing herein:

FIG. 1 is a partial top view of an underwater portion of a marine vessel depicting a tab lift reducing arrangement for a stabilizer flap control surface installation;

FIG. 2 is a partial front view of the installation depicted in FIG. 1;

FIG. 3 is a partial side view of the installation shown in FIGS. 1 and 2; and FIG. 4 is a graphical depiction of test results obtained with respect to the installation depicted in FIGS. 1, 2 and 3.

DETAILED DESCRIPTION OF THE PREFERRED EMBODIMENT

Referring now to the drawing in detail, an underwater portion of a hull 10 of a marine vessel is depicted, undergoing travel in a forward direction 12 within a body of seawater 14. As shown in FIGS. 1 and 2, the hull 10 has a pair of hydrofoil stabilizers 16 fixed thereto and extending laterally therefrom to form part of a hydrodynamic control surface system for selectively maneuvering the marine vessel. Each fixed stabilizer 16 has a leading edge 18 spaced forwardly from its trailing edge on which a pair of control flaps 20 and 22 are mounted for pivotal displacement about a common axis extending through laterally spaced pivot formations 24 and 26 to form a partial span flap arrangement for each flap 20 and 22. Pivotal movement of the flaps 20 and 22 independently of each other is thereby accommodated so as to provide a redundant surface lift control capability for the vessel control system. Thus, when one of the flaps 20 and 22 gets jammed in the dive position for example, a hydrodynamic force denoted by reference numeral 27 in FIG. 2 is exerted on the control surfaces of the stabilizer 16 and flaps 20 and 22. To negate the unwanted lift force of the jammed flap 20 or 22, the unjammed flap 20 or 22 is pivoted in the opposite direction. This causes an offset lift force 28 that is opposite in direction to lift force 27 caused by the jammed flap. Ordinarily such lift force 28 on the unaffected flap portion of the control system barely neutralizes the undesirable lift force 26 generated by the jammed flap portion. The sum of such forces is typically so small that there is no remaining force that can be generated for maneuvering.

In order to provide lift control authority for marine vessel maneuvering, adversely affected by the foregoing referred to jammed flap surface lift force 27, each of the flaps 20 and 22 are respectively provided with trailing edge tabs 30 and 32 as denoted in FIGS. 1 and 3, pursuant to the present invention. As shown in FIG. 3, such tabs 30 and 32, pivotally mounted on the trailing edges of the flaps 20 and 22, are both deflected in the direction opposite to the deflection of the jammed flap 20. Thus, such deflection of the tab 30 reduces the lift associated with the jammed surface lift force 27 exerted on flap 20, while deflection of the tab 32 in same direction as tab 30 increases the recovery lift associated with lift force 28 from flap 22. The reduction of the unwanted lift force 27 and the augmentation of the opposing lift force 28 provide net lift control for maneuvering.

Based on tests performed with respect to the foregoing described tab assisted control arrangement for a partial span flap type of stabilizer control system, a substantial increase in recovered control was achieved as graphically reflected in FIG. 4, wherein percent change in lift is plotted as a function of tab deflection, for a flap angle of 27° and stabilizer angle of 0° as depicted in FIGS. 1, 2 and 3. The present invention accordingly provides a relatively simple method to enhance the capability for emergency post-recovery maneuvering of marine vessels such as submarines by addressing the control surface jam problem.

Obviously, other modifications and variation of the present invention may be possible in light of the foregoing teachings. It is therefore to be understood that within the scope of the appended claims the invention may be practiced otherwise than as specifically described.

What is claimed is:

1. In combination with a marine vessel having a hull undergoing underwater travel and a hydrofoil stabilizer fixed to the hull as part of a lift surface control system having a pair of control flaps mounted on the stabilizer for pivotal deflection independently of each other to effect recovery from jam by the pivotal deflection of one of the flaps in a direction opposite to the pivotal deflection of the other of the flaps induced by said jam during said underwater travel of the hull, the improvement residing in means for improving said recovery from the jam, comprising: a pair of tabs; and means respectively mounting the tabs on said flaps for pivotal deflection in the same direction opposite to the direction of flap deflection induced by said jam with respect to said other of the flaps.

2. The combination as defined in claim 1, wherein said stabilizer extends from the hull laterally with respect to direction of said underwater travel of the hull.

3. The combination as defined in claim 2, including pivot formations projecting from the stabilizer in spaced relation to each other establishing a common pivot axis about which both of the flaps are pivotally deflected.

4. The combination as defined in claim 1, wherein said flaps have tailing edges on which said control tabs are mounted so as to undergo said pivotal deflection independently of each other.

5. In combination with a marine vessel having a hull undergoing underwater travel and a hydrofoil stabilizer fixed to the hull as part of a lift surface control system having a pair of control flaps mounted on the stabilizer for pivotal deflection independently of each other to effect recovery from jam inducing undesirable pivotal deflection of one of the control flaps, the improvement residing in means for improving said recovery from the jam, comprising: a pair of tabs; and means respectively mounting the tabs on said flaps for pivotal deflection in the same direction opposite to the undesirable pivotal deflection induced by said jam.

* * * * *